US005443010A

United States Patent [19]

Dahlitz

[11] Patent Number: 5,443,010

[45] Date of Patent: Aug. 22, 1995

[54] MUZZLE LOADING RIFLE PROJECTILE

[75] Inventor: Ronald R. Dahlitz, Santa Fe Springs, Calif.

[73] Assignee: Buffalo Bullet Company, Santa Fe Springs, Calif.

[21] Appl. No.: 146,963

[22] Filed: Nov. 1, 1993

[51] Int. Cl.[6] ..... F42B 14/04

[52] U.S. Cl. ..... 102/511; 102/501

[58] Field of Search ..... 102/439, 501, 511, 517, 102/529, 524, 526; 42/90; 86/19

[56] References Cited

U.S. PATENT DOCUMENTS

| | | | |
|---|---|---|---|
| 326,231 | 9/1885 | Manning | 102/501 |
| 1,769,263 | 7/1930 | Johnson | 102/501 |
| 1,895,207 | 1/1933 | Rinkel | 102/511 |
| 2,105,528 | 1/1938 | Foisy | 102/529 |
| 4,417,521 | 11/1983 | Dahlitz | 102/511 |
| 4,958,570 | 9/1990 | Harris | 102/517 |

FOREIGN PATENT DOCUMENTS

| | | | |
|---|---|---|---|
| 416724 | 8/1925 | Germany | 102/439 |
| 2729991 | 1/1979 | Germany | 102/501 |
| 120774 | 11/1918 | United Kingdom | 102/501 |
| WO/03693 | 3/1992 | WIPO | 102/511 |

*Primary Examiner*—Harold J. Tudor
*Attorney, Agent, or Firm*—Hawes & Fischer

[57] ABSTRACT

The muzzle loading rifle projectile has a cylindrical body, a hemispherically shaped nose and a hemispherically shaped depression in its base. The cylindrical body includes a band of diamond knurling or grooves and, adjacent the base end, a smooth band of a diameter slightly less than the outer diameter of the knurled band. A coating of lubricant is applied about at least the cylindrical body of the rifle projectile.

3 Claims, 1 Drawing Sheet

MUZZLE LOADING RIFLE PROJECTILE

INTRODUCTION

The present invention relates to a muzzle loading rifle projectile, particularly a muzzle loading bullet that combines the features of a muzzle loading ball with a muzzle loading conical bullet.

In recent decades muzzle loading guns have grown in popularity. They are now being fired by women as well as men, by children as well as adults, and by people of all sizes and ages.

In general there are three types of projectiles which can be used in a muzzle loading gun: (1) a ball, (2) a cylindrical bullet or (3) a sabot. In general a ball is the lightest of these three projectiles. A bullet is the heaviest and is usually preferred for hunting. A sabot is between the ball and bullet in weight and characteristics. An example of a muzzle loading bullet is presented in U.S. Pat. No. 4,417,521 issued Nov. 29, 1983, to Ronald R. Dahlitz.

An object of the present invention is to provide a muzzle loading rifle projectile that retains many of the advantages of a bullet but which is lighter in weight and more suitable for use by children and women.

These and other objects of the present invention will be apparent to those skilled this art from the following description of a preferred embodiment.

BRIEF DESCRIPTION OF THE INVENTION

The muzzle loading rifle projectile of the present invention includes a cylindrical body having a nose end and a base end. A spherical tip extends from the nose end; preferably this spherical tip is a hemisphere. The base end of the projectile includes a depression, the depression being of a size and shape to allow the skirt of material between the depression and the outer surface of the cylindrical body to obturate when the bullet is fired down the barrel of a gun. Preferably there is a band of indentations, or knurling, about the cylindrical body and a substantial smooth band as well, the smooth band being adjacent the base end of the cylindrical body and of a diameter less than the diameter of the knurled band to enable the base of the bullet to be seated and centered in the muzzle of a gun prior to ramming it down through the band. Also, preferably the projectile is a one piece coated with a lubricant.

BRIEF DESCRIPTION OF THE DRAWINGS

The present invention will be further described in connection with the accompanying drawings in which.

DETAILED DESCRIPTION

Figure 1:
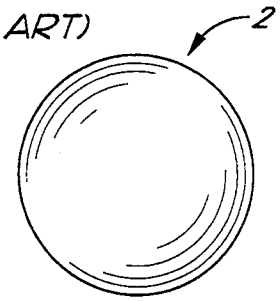
Fig. 1 (PRIOR ART)
FIGS. 1 through 4 are elevational views of various types of prior art projectiles, not necessarily to the same scale.
Figure 2:
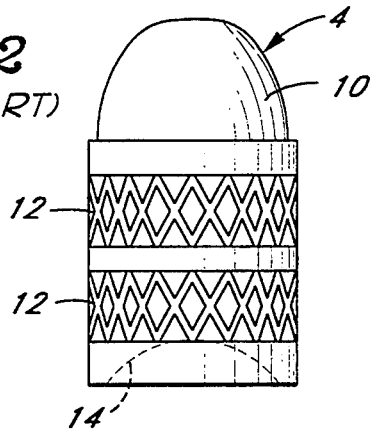
Fig. 2 (PRIOR ART)

Muzzle loading guns can employ any of various types of projectiles. For example, the classic muzzle loading projectile is simply a sphere or ball 2 such as shown in FIG. 1. Also currently offered for use in muzzle loading guns is a bullet type of projectile shown in FIG. 2, such as that described in the aforementioned Dahlitz U.S. Patent, and a sabot type of projectile truncated shown in FIG. 3. In general the bullet 4 includes a conical or hemispherical nose 10, one or more knurled bands 12 and a spherical indentation 14 in its base. It is typically covered with an appropriate lubricant such as a wax or grease.

Figure 3:
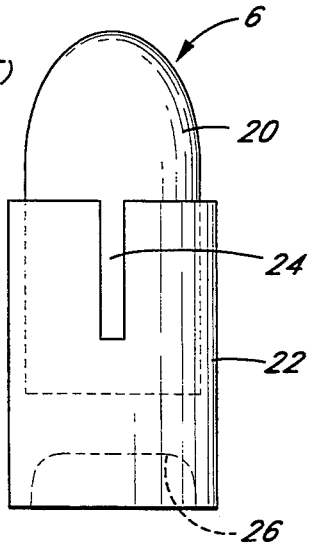
Fig. 3 (PRIOR ART)

The sabot style of projectile shown in FIG. 3 includes a bullet 20 that is received in a jacket 22, often of plastic, this jacket including a series of notches 24 at one end and a deep indentation 26 at the other end. The outer diameter of the jacket 22 is sized to snugly fit in the barrel of a gun. Upon being fired the powder charge exerts pressure on depression 26 to cause the skirt of material between it and the outer surface of jacket 22 to expand or obturate outwardly to fill and substantially seal the barrel of the gun. The rifling along the inner surface of the barrel imparts a rotary motion or spin to the sabot and the bullet it carries as it travels down the barrel. On leaving the muzzle, bullet 20 continues on to the target while jacket 22 falls to the ground in a short distance.

Figure 4:
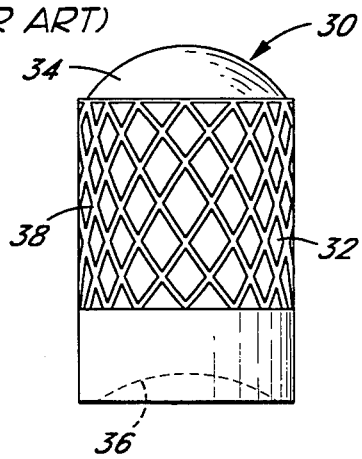
Fig. 4 (PRIOR ART)

There are various types of black powder muzzle loading revolvers which have been in use for many decades. In general, these revolvers include a barrel, a cylinder and a hammer. The cylinder has a series of chambers around its periphery, each chamber receiving from one end a charge of black powder, then a wad to generally seal the chamber and then an appropriate ball or bullet. A firing cap is positioned at the other end of the chamber, and the assembly held by a frame such that when the firing cap is struck by the hammer, the firing cap ignites the black powder to drive the wad and bullet into and through the aligned barrel of the revolver. A general type of typical bullet 30 currently being used in such a revolver is shown in FIG. 4. It has a cylindrical body 32, a squat but rounded or semi-pointed nose portion 34 and a base that may include a slight depression 36. A band of knurling 38 may be provided around the cylindrical body 32 to receive and hold a lubricant.

Figure 5:
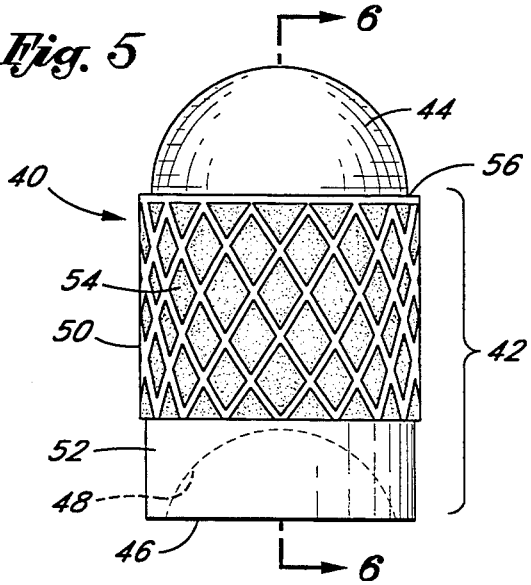
FIG. 5 is an elevational view of the muzzle loading rifle projectile of the present invention but not necessarily to the same scale as that used in any of FIGS. 1–4.
Figure 6:
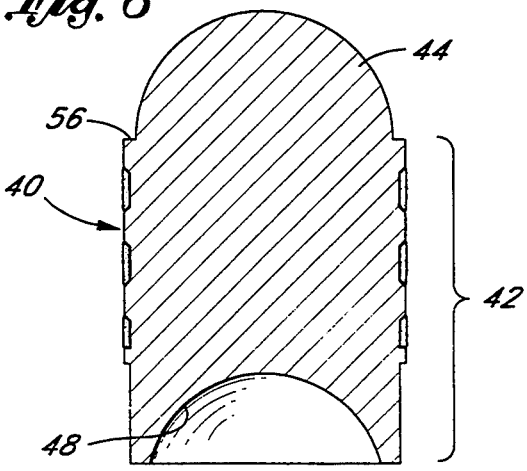
FIG. 6 is a longitudinal cross-section of the projectile shown in FIG. 5.

The one piece rifle projectile of the present invention combines many of the features and advantages of bullet 4 with certain advantages of ball 2. It is shown in elevation in FIG. 5 and in longitudinal cross-section in FIG. 6. There, projectile 40 has a cylindrical body 42, a hemispherical nose 44 and a base 46 that includes an indentation or spherical depression 48. A band 50 of knurling, preferably diamond shaped knurling (which may include grease grooves), extends about a major portion of the outer surface of cylindrical body 42, as shown. Between this knurling or grooves band 50 and the base of the projectile 40 is a smooth band 52, the diameter of which is slightly less than the diameter of the knurled band 50. The knurled band 50 is substantially twice the width of the smooth band 52. Preferably the diameter of smooth band 52 is also less than the inner diameter of the gun's barrel such that smooth band 52 of the projectile may be positioned in the muzzle of the rifle barrel, the smooth band being received in the muzzle to hold the projectile in this orientation until the projectile is rammed home through the barrel by pushing on nose 44 with a ramming rod.

Preferably an appropriate lubricant 54 coats the entire outer surface of the projectile. The indentation of band 50 assist in providing an adequate volume and reservoir of lubricant to ensure that the passage of the projectile down the barrel of the rifle is well lubricated. This lubricant may, for example, be Superlube 1001 offered by Thompson Center or the Pyrodex muzzle loading rifle lubricant offered by the Hodgdon Company of Shawnee Mission, Kans., or Crisco or pure beeswax to give some examples.

Projectile 40 also includes a shoulder 56 at its nose end, since the diameter of hemisphere 44 is slightly less than the diameter of knurled band 50. This shoulder assists in cutting a clean hole into the target or object struck by the projectile.

In general, the one piece projectile of the present invention differs from bullet 4 in that it is significant shorter and lighter in weight. Thus, it is often preferred by women and youths. However, because of its generally cylindrical shape it provides good engagement with the rifling inside the barrel, and significantly increased accuracy over that obtainable with a ball projectile such as shown in FIG. 1. It differs from the revolver projectile shown in FIG. 4 in its provision of a hemispherical nose 44 and depression 48, the skirt and material provided between depression 48 in the outer surface of cylindrical body 42 ablating or billowing out to engage the inner surface of the rifle barrel upon ignition of the powder charge and during passage of the projectile down the rifle barrel.

The projectile of the present invention offers other significant advantages as well. It is easily loaded into the barrel of a muzzle loading rifle, and does not require a patch as does a round ball. For a given powder charge, because it is shorter and of a lighter weight than of a FIG. 2 style bullet, when fired it results in both a higher velocity imparted to the bullet and substantially less recoil on the shooter. It does not produce plastic residue in the barrel or elsewhere as does a sabot. Also, when fired it will have more energy than a round ball, which energy is transmitted to the target on impact (some call this energy "killing power.")

While a preferred embodiment of the present invention has been illustrated and described, variations in this embodiment will be apparent to those skilled in this field. For that reason, the scope of the present invention is not defined by the preferred embodiment but instead is set forth in the following claims.

I claim:

1. A one piece projectile of a caliber appropriate for a muzzle loading rifle of a given barrel diameter, the projectile including a cylindrical body having a nose end and a base end, the surface of the cylindrical body between the nose end and the base end consisting of a knurled band and a smooth band, the width of the knurled band being substantially twice the width of the smooth band, knurling indentations of the knurled band being diamond shaped and continuous over the surface of the knurled band, the diameter of the knurled band determining the projectile's caliber, a hemispherical tip extending from the nose end of the cylindrical body, the hemispherical tip being of a diameter slightly less than the diameter of the cylindrical body and being centered on the cylindrical body to provide a shoulder ring about the base of the hemispherical nose, a coating of lubricant about the surface of the cylindrical body, the lubricant substantially filling the diamond shaped knurling indentations, the smooth band being adjacent the base end of the cylindrical body, the band being substantially smooth and of a diameter less than the diameter of the knurled band and less than the given barrel diameter such that the smooth band is capable of being received in the muzzle of the rifle barrel, and an empty depression in the base of the projectile, the depression being centered and of a diameter to provide a narrow skirt of material between the depression and the smooth band allowing the skirt to obturate when the projectile is fired down a rifle barrel, the depth of the depression being substantially equal to the width of the smooth band.

2. A rifle projectile as set forth in claim 1 in which the depression is substantially a hemisphere.

3. A rifle projectile as set forth in claim 1 in which the length of the projectile is longer than the caliber of the projectile.

* * * * *